United States Patent [19]

Dahl

[11] Patent Number: 4,967,920

[45] Date of Patent: Nov. 6, 1990

[54] PARTIAL TAMPER BAND

[75] Inventor: Randal A. Dahl, Champaign, Ill.

[73] Assignee: Continental White Cap, Inc., Norwalk, Conn.

[21] Appl. No.: 371,115

[22] Filed: Jun. 26, 1989

[51] Int. Cl.[5] ..... B65D 41/34

[52] U.S. Cl. ..... 215/252

[58] Field of Search ..... 215/252, 253

[56] References Cited

U.S. PATENT DOCUMENTS

| | | | |
|---|---|---|---|
| 3,904,062 | 9/1975 | Grussen | 215/252 |
| 3,957,169 | 5/1976 | Coursaut | 215/253 |
| 4,401,227 | 8/1983 | Pehr | 215/252 |
| 4,417,666 | 11/1983 | Roberts | 215/256 |
| 4,479,586 | 10/1984 | Csaszar | 215/258 |
| 4,530,436 | 7/1985 | Wiedmer | 215/246 |
| 4,564,115 | 1/1986 | Imbert | 215/256 |
| 4,565,293 | 1/1986 | Jonas | 215/246 |
| 4,567,993 | 2/1986 | Albrecht | 215/252 |
| 4,669,623 | 6/1987 | Csaszar | 215/252 |
| 4,706,828 | 11/1987 | Zinnbauer | 215/252 X |
| 4,726,482 | 2/1988 | Barriac | 215/252 |

*Primary Examiner*—Donald F. Norton

*Attorney, Agent, or Firm*—Charles E. Brown; Paul Shapiro; Charles A. Brown

[57] ABSTRACT

This relates to a closure for containers wherein the closure is provided with a tamper indicating member. However, in lieu of the tamper indicating member being in the form of a continuous band which remains on the container neck after the closure is removed, the closure indicating member is of a limited circumferential extent filling a notch in a band extending from the closure skirt in lieu of a conventional tamper indicating band. This band does not interlock with the container. Only the tamper indicating member interlocks with the container, which container is provided with the normal tamper bead. The tamper indicating member is attached to the lower edge of the closure skirt by axial bridges and two opposite ends of the band by circumferential bridges. The bridges may all rupture when the closure is removed from the container with the tamper indicating member dropping out and leaving a readily observable notch in the band. On the other hand, one of the circumferential extending bridges may be made of sufficient strength so that the tamper indicating member remains attached to the closure, but its rupture from the remainder of the closure is obvious. If desired, the band may be attached to the closure skirt by a thin web so as to facilitate the tearing off of the band after the closure has been removed, thereby facilitating reclosure.

20 Claims, 1 Drawing Sheet

FIG. 1
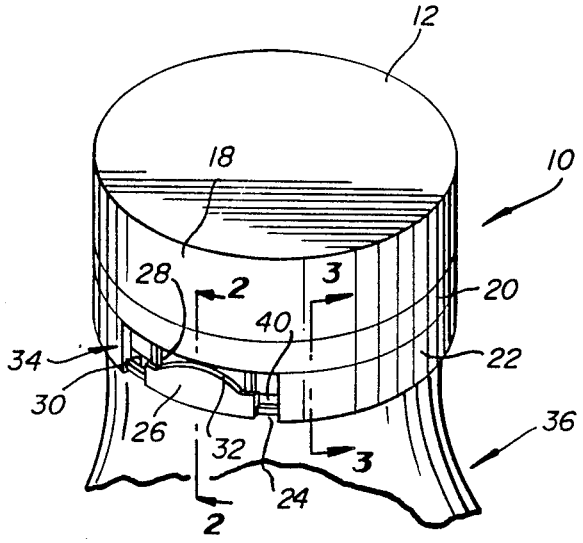
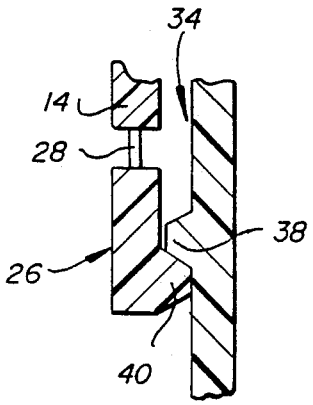
FIG. 2
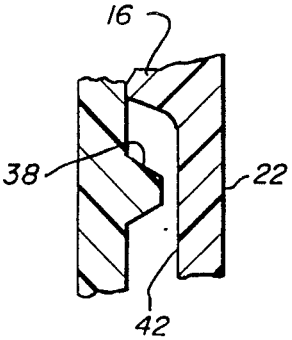
FIG. 3
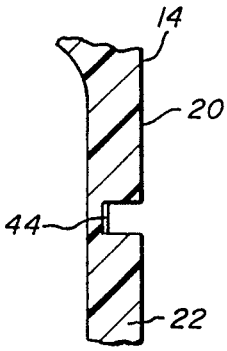
FIG. 5
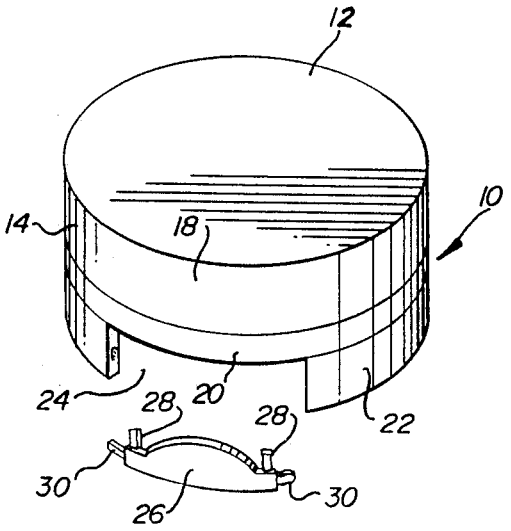
FIG. 4
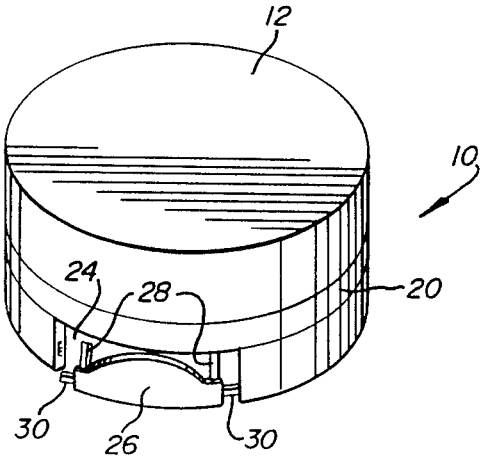
FIG. 6

PARTIAL TAMPER BAND

This invention relates in general to new and useful improvements in tamper bands for closures and more particularly to a tamper band which is only a portion of the circumference of a closure skirt.

Customarily the skirt of a closure is provided with a full circumference tamper band which engages beneath a tamper bead on a container neck finish in a manner wherein when the closure is removed, bridges joining the tamper band to the closure skirt are ruptured and the tamper band is separated from the closure and is left on the neck of the container.

Because the usual tamper indicating band is continuous, it is not as noticeable as a partial tamper band which drops out and leaves a notch in the band area of the closure. Also, by having only a partial circumference tamper band, and the remainder of the band being retained by the closure skirt, there is no longer a tamper band retained on the container neck which is very undesirable in the event the container is of the reuseable type.

Although a circumferential band remains on the lower edge of the skirt after the removable tamper indicating member has been removed, this band may be connected to the skirt by a thin strip of material so that it may be readily torn from the closure prior to the return of the closure to the container for resealing.

In a preferred embodiment of the tamper indicating member, the tamper indicating member is of a domed configuration so as to have an arcuate upper edge opposing the container skirt. The central portion of the upper edge is closely spaced from the underside of the skirt to eliminate any flexing during assembly with the container so as to stop the circumferential bridges from breaking during assembly.

With the above and other objects in view that will hereinafter appear, the nature of the invention will be more clearly understood by reference to the following detailed description, the appended claims, and the several views illustrated in the accompanying drawings.

FIG. 1 is a top perspective view of a closure formed in accordance with this invention and applied to a container.

FIG. 2 is an enlarged fragmentary vertical sectional view taken generally along the line 2—2 of FIG. 1 and shows the cross section of the tamper indicating member and the relationship thereof to the container neck finish.

FIG. 3 is an enlarged fragmentary vertical sectional view taken generally along the line 3—3 of FIG. 1 and shows the cross section of the band ensuring that it is free of engagement with the container tamper band.

FIG. 4 is an exploded top perspective view of the closure with the tamper indicating member removed therefrom.

FIG. 5 is an enlarged fragmentary sectional view through the closure per se similar to FIG. 3 showing the band connected to the underside of the skirt by a thin web so as to facilitate the removal of the band should it be so desired.

FIG. 6 is a top perspective view similar to FIG. 4 but shows the tamper indicating member remaining attached to the band.

Referring now to the drawings in detail, reference is first made to Figure 1 wherein there is illustrated a closure formed in accordance with this invention, the closure being generally identified by the numeral 10. The closure 10 is generally of a conventional construction and includes an end panel 12 and a depending skirt 14. The interior of the skirt 14 will be so constructed whereby it will have an interlocking engagement with a container such as is generally shown in FIG. 3 and identified by the reference numeral 16.

In a preferred embodiment of the invention, the skirt 14 will include an upper part 18 which may be knurled to facilitate turning of the closure 10 should the closure 10 be screw threaded on to a container. A lower part 20 of the skirt 14 may be in the form of a narrow smooth surface band.

In accordance with this invention, there extends downwardly from the band 20 a part circumferential band 22. The band 22, however, is not a tamper indicating band and has no lock with a container neck finish. The band 22 is interrupted so as to define a notch 24 which will occupy generally 25% of the band 20.

In accordance with this invention, there is positioned within the notch 24 a circumferentially extending tamper indicating member 26. The tamper indicating member 26 is removably connected to the closure 10 by a pair of axial bridges 28 which are integral with the lower edge of the band 20 and a pair of circumferential bridges 30 which are integral with opposite ends of the band 22.

It is to be noted that the tamper indicating member 26 is of a domed configuration so as to have an arcuate upper edge 32 opposing the underside of the band 20. The arcuate edge 32 is closely spaced from the underside of the band 20 on the order of 0.005 inch. The purpose of this shape and the close spacing will be described in more detail hereinafter.

In FIG. 1 the closure 10 is illustrated as being secured in a normal manner to a neck finish 34 of a conventional container generally identified by the numeral 36. The neck finish 34 will be configurated to interlock with the interlocking means 16 of the closure 10.

Referring now to FIG. 2, it will be seen that the container neck finish 34 will include a customary circumferential tamper bead 38. Further, it will be seen that the inner surface of the tamper indicating member 26 will be provided with a tamper band 40 of a shape and size to lock beneath the tamper head 38 in a customary manner. At this time it is pointed out that the shape of the edge 32 and the closeness thereof to the underside of the band 20 serves to eliminate any flexing of the tamper indicating member 26 during assembly of the closure 10 with the container 36. This will stop the bridges 30 from breaking during assembly.

Reference is again made to FIG. 3 wherein that the band 22 has a smooth inner surface 42 whereby the band 22 in no way interlocks with the container neck finish and thus when the closure 10 is removed, the band 22 will freely move off of the neck finish together with the remainder of the closure 10.

Referring now to FIG. 5, it will be seen that, if desired, the band 22 may be connected to the lower edge of the skirt 14 by way of a thin web 44 which is readily tearable so that after the closure 10 has been removed from the container 36, before reapplying the closure 10 to reseal the container, the band 22 may be torn from the closure 10.

Reference is now made to FIG. 6 wherein it is shown that one of the circumferential bridges 30 remains attached to the band 22. This one bridge may be made heavier than the other bridges so as to assure against breakage of the bridge while permitting the tamper indicating member 26 to freely move out of the notch 24 and thus clearly indicate that the closure 10 has been moved to an open position.

Although only a preferred embodiment of the tamper indicating member has been specifically illustrated and described herein, it is to be understood that minor variations may be made in the closure without departing from the spirit and scope of the invention as defined by the appended claims.

I claim:

1. A closure for use with a container having a neck configuration with a tamper bead, said closure including an end panel and a depending skirt having internal means for removably locking said closure on a container, a band depending from said skirt, said band being interrupted by a notch, and a tamper indicating member positioned within said notch and releasably retained in said notch by a plurality of bridges, said tamper indicating member having on an inner surface thereof a lug for locking beneath a container neck tamper bead to effect rupture of at least a plurality of said bridges and displacement of said tamper indicating member when said closure is removed from a container, certain of said bridges being connected to said skirt and others of said bridges being connected to said band.

2. A closure according to claim 1 wherein one of said bridges connected to said band is heavier than others of said bridges and normally not rupturable whereby said tamper indicating member remains attached to said closure.

3. A closure according to claim 1 wherein said tamper indicating member has an arcuate edge opposing said skirt with a central part of said arcuate edge being closest to said skirt.

4. A closure according to claim 3 wherein said central part is spaced from said skirt on the order of 0.005 inch.

5. A closure according to claim 1 wherein said tamper indicating member has a circumferential extent on the order of 25 percent of the circumference of said skirt.

6. A closure according to claim 1 wherein said band has a rupturable connection with said skirt whereby once said closure is removed, said band may be selectively removed from said skirt.

7. A closure according to claim 1 wherein each of said bridges is in the form of a narrow elongated member.

8. A closure for use with a container having a neck configuration with a tamper bead, said closure including an end panel and a depending skirt having internal means for removably locking said closure on a container, a band depending from said skirt, said band being interrupted by a notch, and a tamper indicating member positioned within said notch and releasably retained in said notch by a plurality of bridges, said tamper indicating member having on an inner surface thereof a lug for locking beneath a container neck tamper bead to effect rupture of at least a plurality of said brides and displacement of said tamper indicating member when said closure is removed from a container, certain of said bridges extending from said tamper indicating member axially of said notch, and other of said bridges extending from said tamper indicating member circumferentially.

9. A closure according to claim 8 wherein one of said circumferentially extending bridges is heavier than others of said bridges and normally not rupturable whereby said tamper indicating member remains attached to said closure.

10. A closure according to claim 8 wherein said tamper indicating member has an arcuate edge opposing said skirt with a central part of said arcuate edge being closest to said skirt.

11. A closure according to claim 10 wherein said central part is spaced from said skirt on the order of 0.005 inch.

12. A closure according to claim 8 wherein said tamper indicating member has a circumferential extent on the order of 25 percent of the circumference of said skirt.

13. A closure according to claim 8 wherein said band has a rupturable connection with said skirt whereby once said closure is removed, said band may be selectively removed from said skirt.

14. A closure according to claim 8 wherein each of said bridges is in the form of a narrow elongated member.

15. A closure for use with a container having a neck configuration with a tamper bead, said closure including an end panel and a depending skirt having internal means for removably locking said closure on a container, a band depending from said skirt, said band being interrupted by a notch, and a tamper indicating member positioned within said notch and releasably retained in said notch by a plurality of bridges, said tamper indicating member having on an inner surface thereof a lug for locking beneath a container neck tamper bead to effect rupture of at least a plurality of said bridges and displacement of said tamper indicating member when said closure is removed from a container, one of said bridges being heavier than others of said bridges and normally not rupturable whereby said tamper indicating member remains attached to said closure.

16. A closure according to claim 15 wherein said tamper indicating member has an arcuate edge opposing said skirt with a central part of said arcuate edge being closest to said skirt.

17. A closure according to claim 16 wherein said central part is spaced from said skirt on the order of 0.005 inch.

18. A closure according to claim 15 wherein said tamper indicating member has a circumferential extent on the order of 25 percent of the circumference of said skirt.

19. A closure according to claim 15 wherein said band has a rupturable connection with said skirt whereby once said closure is removed, said band may be selectively removed from said skirt.

20. A closure according to claim 15 wherein each of said bridges is in the form of a narrow elongated member.

* * * * *